US008615832B2

(12) United States Patent
Wang

(10) Patent No.: US 8,615,832 B2
(45) Date of Patent: Dec. 31, 2013

(54) NURSING BED

(76) Inventor: Xiading Wang, Fuzhou (CN)

( * ) Notice: Subject to any disclaimer, the term of this patent is extended or adjusted under 35 U.S.C. 154(b) by 320 days.

(21) Appl. No.: 12/954,597

(22) Filed: Nov. 24, 2010

(65) Prior Publication Data

US 2011/0131732 A1 Jun. 9, 2011

Related U.S. Application Data

(63) Continuation-in-part of application No. 12/634,066, filed on Dec. 9, 2009, now abandoned.

(30) Foreign Application Priority Data

Aug. 4, 2010 (CN) ..... 2010 1 0244717
Aug. 4, 2010 (CN) ..... 2010 2 0281211 U

(51) Int. Cl.
*A61G 7/05* (2006.01)

(52) U.S. Cl.
USPC ..... 5/724; 5/737

(58) Field of Classification Search
USPC ..... 5/187, 690, 699, 484, 737, 724
See application file for complete search history.

(56) References Cited

U.S. PATENT DOCUMENTS 4,052,243 A * 10/1977 Yazawa et al. ..... 156/265
5,598,592 A * 2/1997 Castellani ..... 5/627

* cited by examiner

*Primary Examiner* — Fredrick Conley
(74) *Attorney, Agent, or Firm* — Matthias Scholl P.C.; Matthias Scholl

(57) ABSTRACT

A nursing bed, including at least a net-shaped fabric with a mesh opening, and a bearing frame. The net-shaped fabric includes a warp and a weft interwoven in a vertical direction. An interweaving point of the warp and the weft is fastened by a fixed connection. The diameter or inscribed circle diameter of the mesh opening is 2-6 times the diameter of the warp and the weft. The ratio of the area of an opening of the mesh opening to the area of the mesh opening is 35% to 78%. The diameter or inscribed circle diameter of the mesh opening is less than 1.5 mm. The diameter of the warp and the weft is less than 0.55 mm. The thickness of the net-shaped fabric is less than 1.1 mm. At least two edges of the net-shaped fabric are hanging between two opposite edges of the bearing frame.

10 Claims, 4 Drawing Sheets

NURSING BED

CROSS-REFERENCE TO RELATED APPLICATIONS

This application is a continuation-in-part of U.S. Ser. No. 12/634,066 filed on Dec. 9, 2009, and further claims priority benefits to Chinese Patent Application No. 201020281211.4 filed on Aug. 4, 2010, and to Chinese Patent Application No. 201010244717.2 filed on Aug. 4, 2010. The contents of all of the aforementioned applications, including any intervening amendments thereto, are incorporated herein by reference.

BACKGROUND OF THE INVENTION

1. Field of the Invention

The invention relates to a nursing bed, and more particularly to a nursing bed for bedridden patients.

2. Description of the Related Art

Nowadays nursing beds are widely used in hospitals. US Pat. Publ. No 20060207030 discloses a nursing bed, a bed body thereof is a single layer of sheet fabric with a mesh opening by interweaving a warp and a weft in a vertical direction and, an interweaving point of the warp and the weft is fastened by a fixed connection, and a diameter or diagonal length of the mesh opening is more than or equal to a diameter of the warp and the weft and less than 30 times the diameter of the warp and the weft. However, the warp and the weft easily hurt skin of patients, and affect air permeability of the skin and recovery of the patients.

SUMMARY OF THE INVENTION

In view of the above-described problem, it is one objective of the invention to provide a nursing bed that is capable of addressing above-mentioned problems.

To achieve the above objectives, in accordance with one embodiment of the invention, provided is a nursing bed, comprising a net-shaped fabric with a mesh opening, and a bearing frame. The net-shaped fabric comprises a warp and a weft interwoven in a vertical direction, an interweaving point of the warp and the weft is fastened by a fixed connection, the diameter or inscribed circle diameter of the mesh opening is 2-6 times the diameter of the warp and the weft, the ratio of the area of an opening of the mesh opening to the area of the mesh opening is 35% to 78%, the diameter or inscribed circle diameter of the mesh opening is less than 1.5 mm, the diameter of the warp and the weft is less than 0.55 mm, the thickness of the net-shaped fabric is less than 1.1 mm, at least two edges of the net-shaped fabric are hang between two opposite edges of the bearing frame whereby forming a mutual positioning structure.

In a class of this embodiment, a tensile layer is disposed at the edge of the net-shaped fabric or along a cutting line thereof.

In a class of this embodiment, the tensile layer is made of materials coated on the net-shaped fabric, and parts or all of the materials block mesh openings that are coated.

In a class of this embodiment, the tensile layer comprises one of a soft fabric, a film, or a non-woven fabric that is coated and fixed on the net-shaped fabric, or on materials coated on the net-shaped fabric.

In a class of this embodiment, multiple fixing edges are disposed on edges or strengthening edges of the net-shaped fabric and the bearing frame mutually positioning each other, the fixing edge comprises a sleeve surrounded by the edges and the tensile layer, and a columnar pin disposed in the sleeve, and the bearing frame comprises a cavity operating to receive the sleeve and the columnar pin, and a groove allowing the net-shaped fabric to pass thereby.

In a class of this embodiment, the bearing frame is a rectangular frame formed by a pair of long edges and a pair of short edges, the fixing edge comprising the columnar pin are capable of rotating a circumference less than 6 cm in a reverse direction in a cavity formed by the long edges, and rotation of the fixing edge can be fixed at any position.

In a class of this embodiment, multiple fixing edges are disposed on edges or strengthening edges of the net-shaped fabric and the bearing frame mutually positioning each other, the fixing edges are edges or strengthening edges fixed on a columnar pin, and the bearing frame comprises a cavity operating to receive the fixing edges, and a groove allowing the net-shaped fabric to pass thereby.

In a class of this embodiment, a rigid strip is disposed on the tensile layer, the width of the rigid strip is less than that of the tensile layer, the rigid strip and the tensile layer form a fixing edge, a hanging hole is disposed on the fixing edge, a hanging column is disposed on the bearing frame, the hanging hole and the hanging column form a removable positioning structure, and a normal displacement of a fixing edge between adjacent hanging holes due to elastic bending is less than 5 mm.

In a class of this embodiment, the edges or the tensile layer of the net-shaped fabric is fixed on the bearing frame via adhesive.

In a class of this embodiment, the bearing frame is a rectangular frame formed by a pair of long edges and a pair of short edges, the distance between the long edges and that between the short edges are adjustable, an adjusting range of the long edges is no greater than 6 cm, an adjusting range of the short edges is no greater than 9 cm, the long edges simultaneously move in a reverse direction and the short edges separately move during adjustment, and movement of the long edges and the short edges can be fixed at any position.

In a class of this embodiment, edges of the net-shaped fabric and the bearing frame mutually positioning each other correspond to hip curves and each has heaveandset wave ruffling, and the wave ruffling is fixed in the tensile layer.

In a class of this embodiment, the width of the net-shaped fabric disposed between two edges of the bearing frame is 1 mm to 20 mm longer than that between the two edges, the diameter or inscribed circle diameter of the mesh opening is less than 0.8 mm, the diameter of the warp and the weft is less than 0.27 mm, and the thickness of the net-shaped fabric is less than 0.55 mm.

In a class of this embodiment, the diameter or inscribed circle diameter of the mesh opening is less than 0.3 mm, the diameter of the warp and the weft is less than 0.08 mm, and the thickness of the net-shaped fabric is less than 0.16 mm.

In a class of this embodiment, the net-shaped fabric is a single-layered plain-weave structure interwoven by the warp and the weft, an error in length of the warp and the weft is within a range of ±20% of a rating value, an angle between the warp and the weft is greater than 60°.

In a class of this embodiment, one of two adjacent interweaving points of the warp and the weft is fastened by a fixed connection, and the other one thereof is fastened by an unfixed connection.

In a class of this embodiment, the warp and the weft at the edge of the net-shaped fabric, especially the edge hanging the bearing frame are densely interwoven.

In a class of this embodiment, multiple warp interwoven strips or weft interwoven strips are disposed on the net-shaped fabric in a direction of one of the strip or the weft, or in directions of the strip and the weft, the width of the interwoven strip is less than 3 mm, and the interwoven strips are uniformly distributed on the net-shaped fabric and in the shape of a pectination or a grid.

In a class of this embodiment, the interwoven strips are fastened by a fixed connection.

Advantages of the invention include: 1) the net-shaped fabric comprises the mesh opening, and dense warp and weft interwoven with each other, and is fixed to the bearing frame along the edge thereof via the tensile layer, which ensures the warp and the weft do not hurt skin of patients, guarantees good air permeability of the skin, prevents bedsore, and creates a good environment for recovery of fire victims. The dimensions of the materials specified herein are critical for achieving these advantages and are not a simple matter of engineering design choice.

Figure 1:
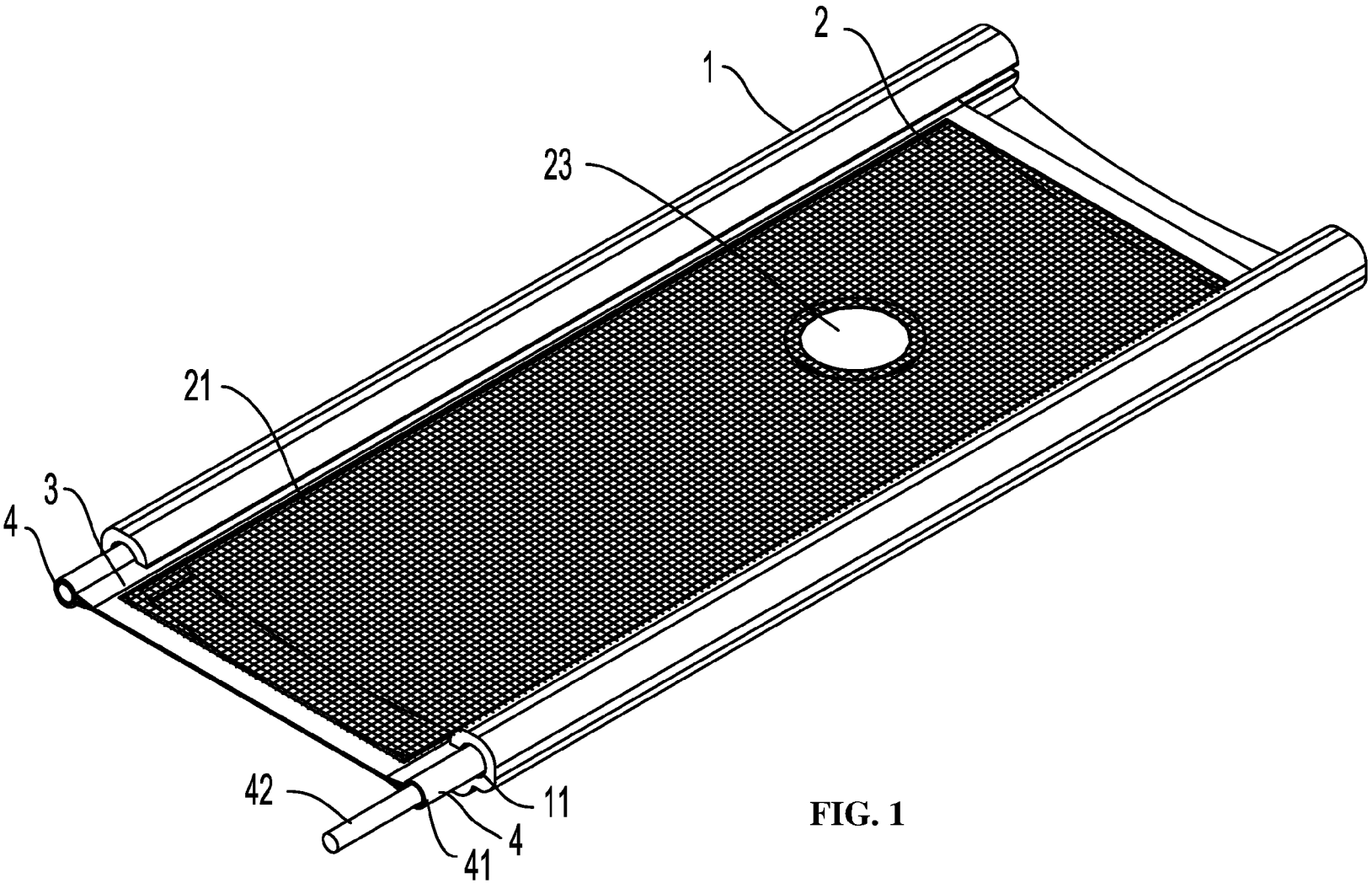
FIG. 1 is a schematic view of a nursing bed of an exemplary embodiment of the invention.

In the drawings, the following reference numbers are used:

1-bearing frame; 2-net-shaped fabric; 3-tensile layer; 4-fixing edge; 11-cavity; 12-groove; 21-warp and weft; 22-mesh opening; 23-outlet; 24-interwoven strip; 25-wave ruffling; 31-coverage area; 32-half coverage area; 33-soft fabric; 41-sleeve; 42-columnar pin; 43-rigid strip; 44-hanging hole

DETAILED DESCRIPTION OF THE EMBODIMENTS

As shown in FIG. 1, a nursing bed of the invention comprises a bearing frame 1, and a net-shaped fabric 2 hang on the bearing frame 1. The bearing frame 1 is disposed on a normal bedstead, or on a bedstead of a heat-insulating nursing bed with a temperature and humidity regulating function, or legs are disposed at four corners of the bearing frame 1 whereby forming a simple nursing bed.

The width of the net-shaped fabric 2 disposed between two edges of the bearing frame 1 is 1 mm to 20 mm longer than that between the two edges.

The diameter or inscribed circle diameter of the mesh opening is less than 0.8 mm, the diameter of the warp and the weft is less than 0.27 mm, and the thickness of the net-shaped fabric is less than 0.55 mm.

For better resolution of force applied by a patient, the net-shaped fabric 2 is slightly concave and loose, and is not in a tension state, so that elastic elongation or fracture does not occur.

Figure 4:
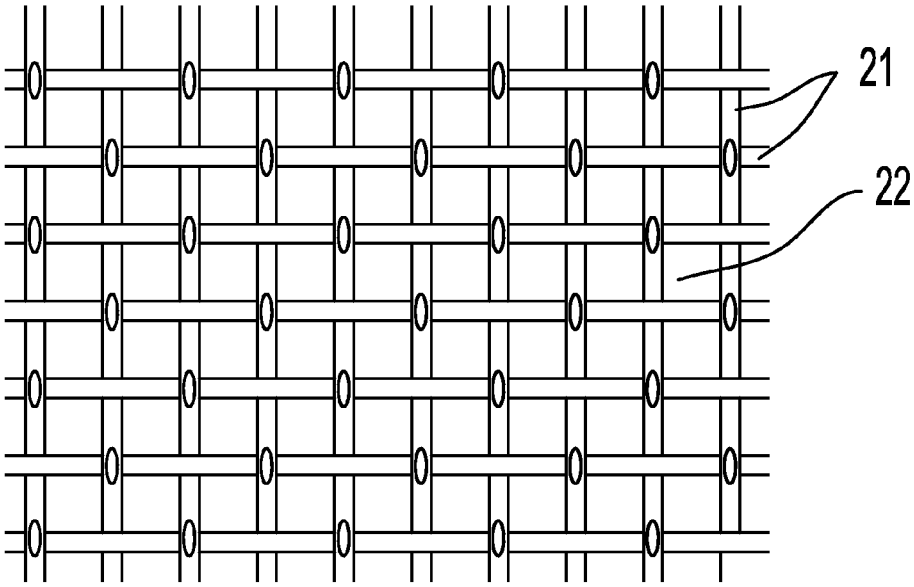
FIG. 4 is a partial view of a net-shaped fabric.

As shown in FIG. 4, the diameter or inscribed circle diameter of the mesh opening 22 on part of the net-shaped fabric 2 is less than 0.8 mm, the diameter of the warp and the weft 21 is less than 0.27 mm, and the thickness of the net-shaped fabric 2 is less than 0.55 mm.

The diameter or inscribed circle diameter of the mesh opening 22 on other part of the net-shaped fabric 2 is less than 0.3 mm, the diameter of the warp and the weft 21 is less than 0.08 mm, and the thickness of the net-shaped fabric 2 is less than 0.16 mm. The part of the net-shaped fabric 2 is more fine and close, which is beneficial for wound of skin of the patient. In details, the part is corresponding to wound that is pressed by the patient himself in bed, and an area thereof is larger than a wound area. Nurses can spray cleaning fluid or liquor on the wound via the mesh opening 22.

An outlet 23 is disposed at a hip of the patient, and a tensile layer 3 is disposed at the edge of the outlet 23, whereby reinforcing the net-shaped fabric 2, and preventing drawnwork or partial fracture.

Figure 2:
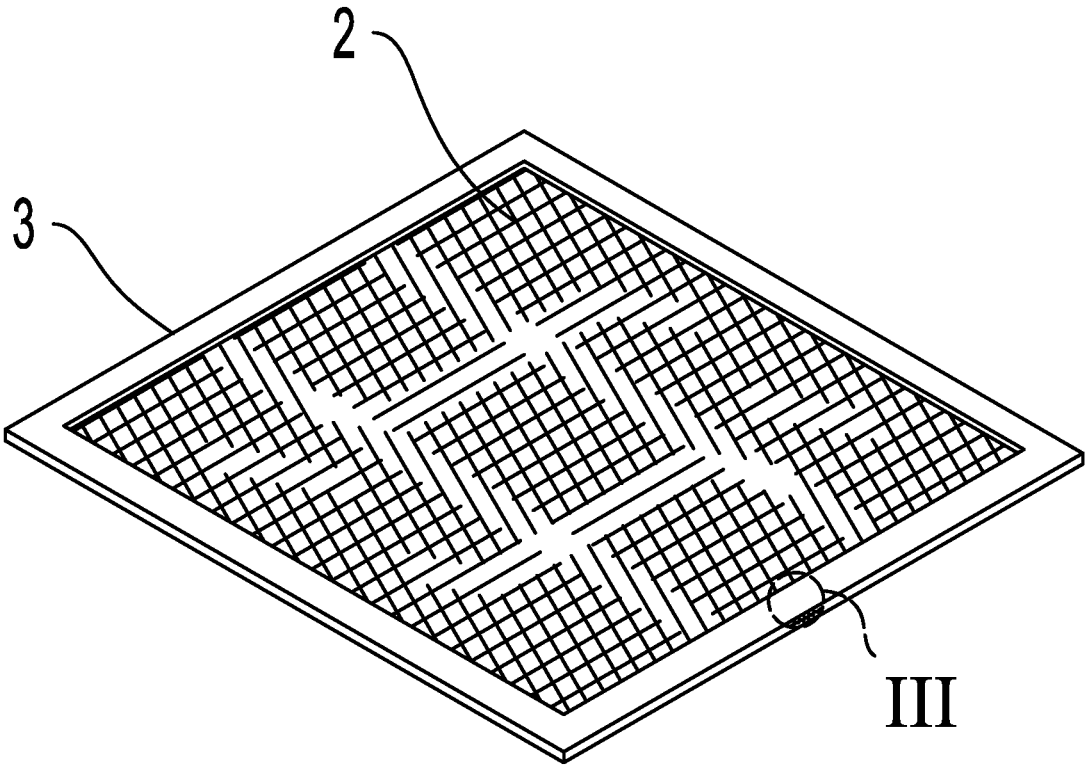
FIG. 2 is a schematic view of a net-shaped fabric of the invention.
Figure 3:
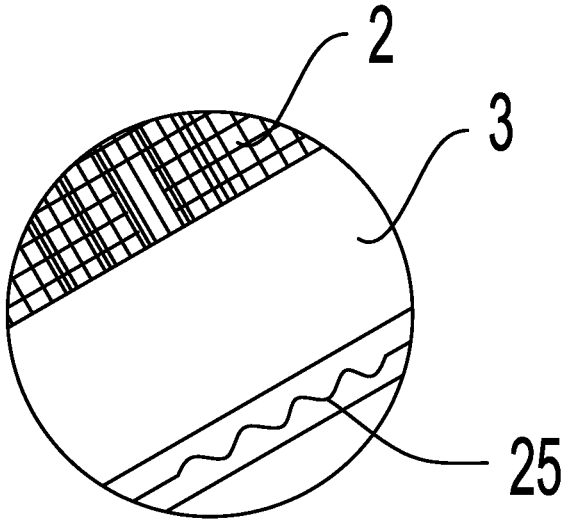
FIG. 3 is a partial enlarged view of FIG. 2.

As shown in FIGS. 1 and 2, edges of the net-shaped fabric 2 and the bearing frame 1 mutually positioning each other correspond to hip curve of the patient, and each has a heave-andset wave ruffling 25, and the wave ruffling 25 is fixed in the tensile layer 3.

As shown in FIG. 4, the net-shaped fabric 2 comprises a mesh opening 22, and a warp and a weft 21 interwoven in a vertical direction, an interweaving point of the warp and the weft 21 is fastened by a fixed connection, adhesive, or heating. As the adhesive is used, one of two adjacent interweaving points of the warp and the weft 21 is fastened by a fixed connection, and the other one thereof is fastened by an unfixed connection (as shown in a dashed line in FIG. 4). This ensure smooth surface of the net-shaped fabric, and prevents the surface thereof from being contaminated by the adhesive.

In the invention, plain weave using square holes is used. Plain weave facilitates optimum effect in terms of stretch proofing of the net-shaped fabric, easy cleaning, the mesh opening, the thickness of the fabric, and so on. Preferably, the net-shaped fabric 2 is a single-layered plain-weave structure interwoven by the warp and the weft 21, an error in length of the warp and the weft 21 is within a range of ±20% of a rating value, an angle between the warp and the weft 21 is greater than 60°. The mesh opening 22 comprises an opening, and a warp and a weft 21 surrounding the opening.

Figure 5:
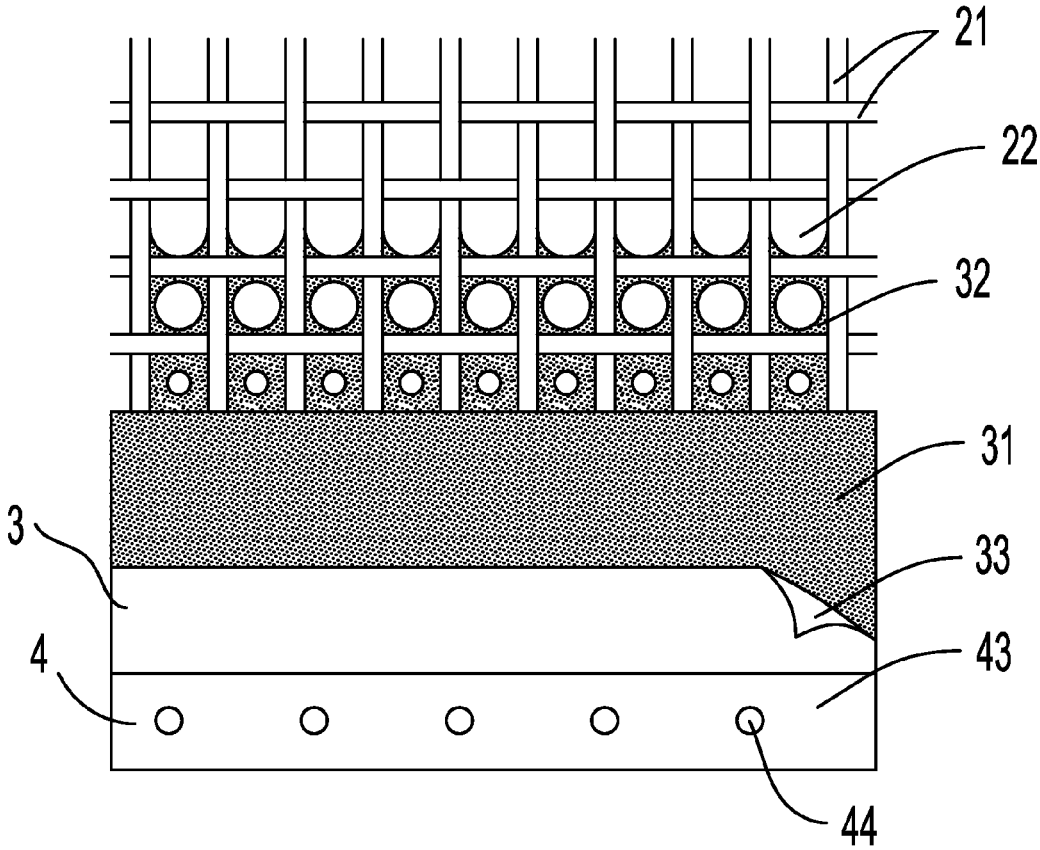
FIG. 5 is another partial view of a net-shaped fabric.

As shown in FIG. 5, a tensile layer 3 is disposed at the edge of the net-shaped fabric 2 or along a cutting line thereof, and the tensile layer 3 and the bearing frame 1 form a mutual positioning structure. The edge described hereinafter comprises surrounding edges, cutting edges, edges at the opening, and so on. The warp and the weft 21 at the edge of the net-shaped fabric, especially the edge hanging the bearing frame 1 are densely interwoven whereby improving tensile force at the edge.

Figure 6:
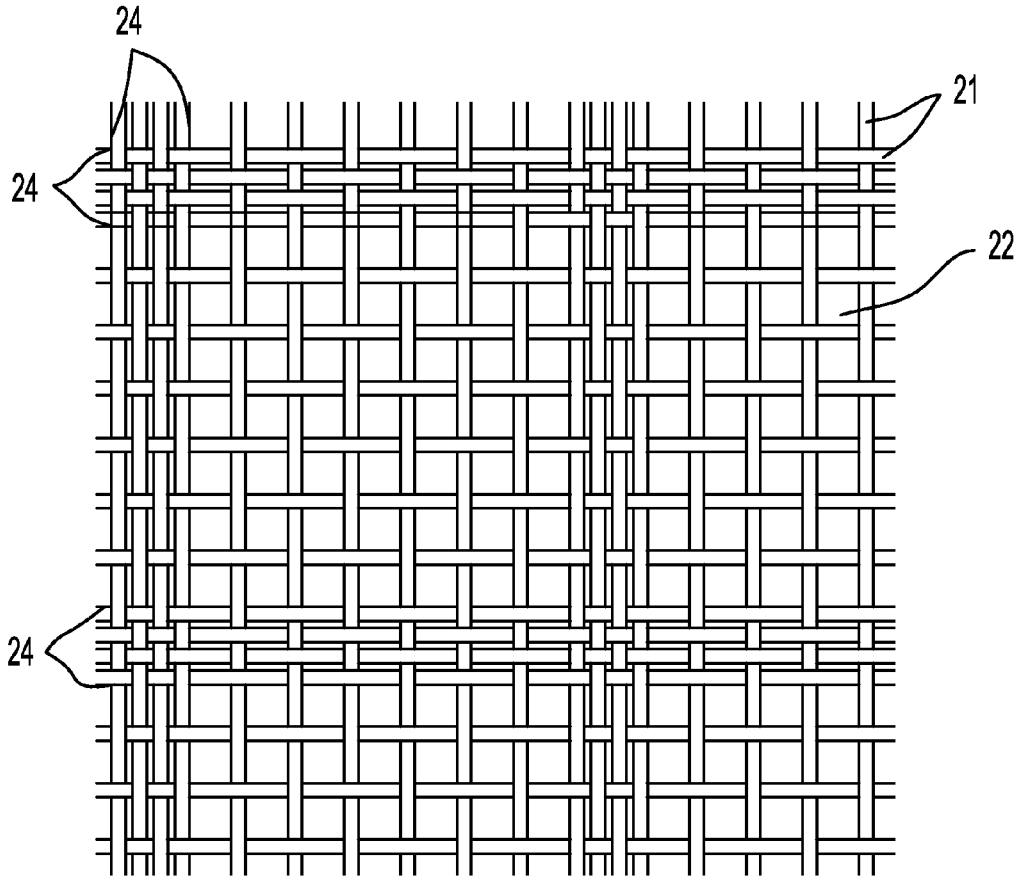
FIG. 6 is a further partial view of a net-shaped fabric.

As shown in FIG. 6, multiple warp interwoven strips 24 or weft interwoven strips 24 are disposed on the net-shaped fabric 2 in a direction of one of the strip or the weft, or in directions of the strip and the weft, the width of the interwoven strip 24 is less than 3 mm, and the interwoven strips 24 are uniformly distributed on the net-shaped fabric 2 and in the shape of a pectination or a grid, whereby improving bearing capability and tensile capability of the fabric, and positioning performance of the warp and the weft. The warp and the weft 21 on the interwoven strips 24 are fastened via a fixed connection. In an embodiment, adhesive is disposed on strip at the back of the net-shaped fabric 2 for connection.

As shown in FIG. 5, the tensile layer 3 is made of materials coated on the net-shaped fabric 2, and parts or all of the materials block mesh openings 22 that are coated. The edge of net-shaped fabric 2 is heavily coated, and the mesh opening is complexly blocked, as indicated as a coverage area 31 in FIG. 5. The thickness of the net-shaped fabric 2 becomes more thinner from the edge to the center thereof whereby forming a half coverage area 32 in which the mesh opening is partially blocked.

Strengthening materials are coated on an intersection point between the warp and the weft, and thickness thereof gradually decreases, or stepwisely decreases, whereby preventing intensity catastrophe occurring at a junction between the tensile layer and the non-tensile layer. The materials are soft flexible structure adhesive, which is better than normal adhesive in terms of shear strength, tensile strength, peel strength, non-uniform tear strength, and so on.

The tensile layer 3 comprises one of a soft fabric 33, a film, or a non-woven fabric that is coated and fixed on the net-shaped fabric 2, or on the materials coated on the net-shaped fabric 2. The soft fabric 33 can be coated on one side or both sides of the net-shaped fabric 2 whereby improving strength thereof and implementing mutual positioning between the net-shaped fabric 2 and the bearing frame 1.

Figure 7:
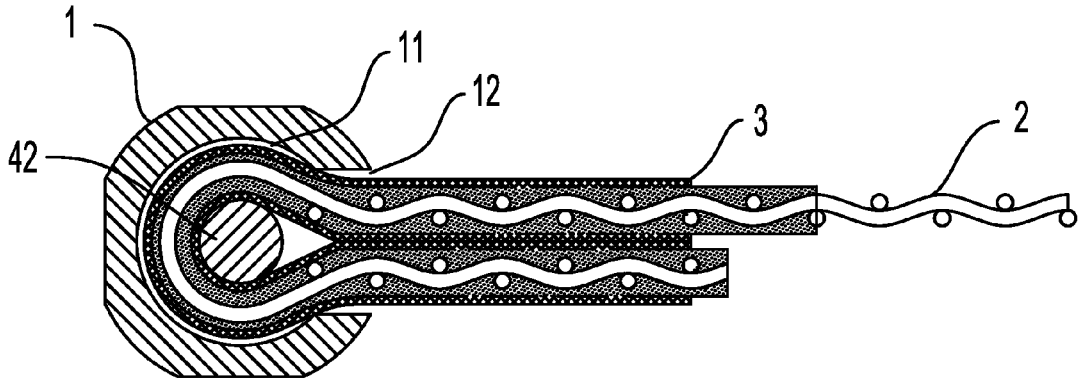
FIG. 7 is a partially cross-sectional view of a tensile layer.

As shown in FIGS. 1 and 7, mutual positioning between the net-shaped fabric 2 and the bearing frame 1 is implemented by adhesion and is removable so that replacement, disassembly or cleaning is convenient. The specific method is as follows:

1. multiple fixing edges 4 are disposed on the tensile layer 3 of edges of the net-shaped fabric 2 and the bearing frame 1 mutually positioning each other, the fixing edge 4 comprises a sleeve 41 surrounded by the tensile layer 3, and a columnar pin 42 disposed in the sleeve 41, and the bearing frame 1 comprises a cavity 11 operating to receive the sleeve 41 and the columnar pin 42, and a groove 12 allowing the net-shaped fabric 2 to pass thereby. After the columnar pin 42 is pulled out, the net-shaped fabric 2 is separated form the bearing frame 1, which is suitable for a bed partially using the net-shaped fabric 2. In details, the net-shaped fabric 2 in FIG. 1 is a whole piece of net-shaped fabric 2, or a partially used net-shaped fabric 2, and is used for a hip of a patient during cleaning of defecation; other parts thereof can use normal fabrics that are assembled altogether.
2. multiple fixing edges 4 are disposed on the tensile layer 3 of edges of the net-shaped fabric 2 and the bearing frame 1 mutually positioning each other, the fixing edge 4 is a tensile layer 3 fixed on a columnar pin 42, and the bearing frame 1 comprises a cavity 11 operating to receive the fixing edges 4, and a groove 12 allowing the net-shaped fabric 2 to pass thereby. The columnar pin 42 is fixed to the tensile layer 3, which features good integrity.
3. A fixing edge 4 is a rigid strip 43 disposed on the tensile layer 3. As shown in FIG. 5, the width of the rigid strip 43 is less than that of the tensile layer 3, the rigid strip 43 and the tensile layer 3 form a fixing edge 4, a hanging hole 44 is disposed on the fixing edge 4, a hanging column is disposed on the bearing frame 1, the hanging hole 44 and the hanging column form a removable positioning structure, and a normal displacement of a fixing edge between adjacent hanging holes due to elastic bending is less than 5 mm.

For example, the hanging holes 44 are uniformly disposed on the rigid strip 43, the hanging column received in the hanging hole 44 is disposed on the bearing frame 1. Mutual positioning between the hanging hole 44 and the hanging column makes disassembly convenient and replacement simple.

4. The simplest method is to fix the net-shaped fabric 2 on the bearing frame 1 along the tensile layer 3 via adhesion whereby forming a mutual positioning structure. The method features high requirement for operation of changing the net-shaped fabric, and a simple structure.

To implement adjustment of tightness of the net-shaped fabric 2 on the bearing frame 1, the bearing frame 1 is a rectangular frame formed by a pair of long edges and a pair of short edges, the distance between the long edges and that between the short edges are adjustable, an adjusting range of the long edges is no greater than 6 cm, an adjusting range of the short edges is no greater than 9 cm, the long edges simultaneously move in a reverse direction and the short edges separately move during adjustment, and movement of the long edges and the short edges can be fixed at any position.

Alternatively, the bearing frame 1 is a rectangular frame formed by a pair of long edges and a pair of short edges, the fixing edge comprising the columnar pin 42 are capable of rotating a circumference less than 6 cm in a reverse direction in a cavity 11 formed by the long edges, and rotation of the fixing edge can be fixed at any position.

To summarize, the net-shaped fabric 2 is disposed on two long edges, and the long edge of the nursing bed can be divided into multiple sections according to posture of the patient in bed, and the sections can be connected to each other via hinges whereby forming a sitting and sleeping bed.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A nursing bed, comprising:

a net-shaped fabric with a mesh opening; and a bearing frame;

wherein:

said net-shaped fabric comprises a warp and a weft interwoven in a vertical direction;

an interweaving point of said warp and said weft is fastened by a fixed connection;

the diameter or inscribed circle diameter of said mesh opening is 2-6 times the diameter of said warp and said weft;

the ratio of the area of an opening of said mesh opening to the area of said mesh opening is 35% to 78%;

the diameter or inscribed circle diameter of said mesh opening is less than 1.5 mm;

the diameter of said warp and said weft is less than 0.55 mm;

the thickness of said net-shaped fabric is less than 1.1 mm;

at least two edges of said net-shaped fabric are hung between two opposite edges of said bearing frame whereby forming a mutual positioning structure;

a tensile layer is disposed at the edge of said net-shaped fabric or along a cutting line thereof;

multiple fixing edges are disposed on edges or strengthening edges of said net-shaped fabric and said bearing frame mutually positioning each other;

said fixing edge comprises a sleeve surrounded by said edges and said tensile layer, and a columnar pin disposed in said sleeve; and said bearing frame comprises a cavity operating to receive said sleeve and said columnar pin, and a groove allowing said net-shaped fabric to pass thereby.

2. The nursing bed of claim 1, wherein said bearing frame is a rectangular frame formed by a pair of long edges and a pair of short edges;

said fixing edge comprising said columnar pin are capable of rotating a circumference less than 6 cm in a reverse direction in a cavity formed by said long edges; and rotation of said fixing edge can be fixed at any position.

3. A nursing bed, comprising:

a net-shaped fabric with a mesh opening; and a bearing frame;

wherein:

said net-shaped fabric comprises a warp and a weft interwoven in a vertical direction;

an interweaving point of said warp and said weft is fastened by a fixed connection;

the diameter or inscribed circle diameter of said mesh opening is 2-6 times the diameter of said warp and said weft;

the ratio of the area of an opening of said mesh opening to the area of said mesh opening is 35% to 78%;

the diameter or inscribed circle diameter of said mesh opening is less than 1.5 mm;

the diameter of said warp and said weft is less than 0.55 mm;

the thickness of said net-shaped fabric is less than 1.1 mm;

at least two edges of said net-shaped fabric are hung between two opposite edges of said bearing frame whereby forming a mutual positioning structure;

a tensile layer is disposed at the edge of said net-shaped fabric or along a cutting line thereof;

multiple fixing edges are disposed on edges or strengthening edges of said net-shaped fabric and said bearing frame mutually positioning each other;

said fixing edges are edges or strengthening edges fixed on a columnar pin; and said bearing frame comprises a cavity operating to receive said fixing edges, and a groove allowing said net-shaped fabric to pass thereby.

4. The nursing bed of claim 3, wherein said bearing frame is a rectangular frame formed by a pair of long edges and a pair of short edges;

the distance between said long edges and that between said short edges are adjustable;

an adjusting range of said long edges is no greater than 6 cm;

an adjusting range of said short edges is no greater than 9 cm;

said long edges simultaneously move in a reverse direction and said short edges separately move during adjustment; and movement of said long edges and said short edges can be fixed at any position.

5. The nursing bed of claim 3, wherein edges of said net-shaped fabric and said bearing frame mutually positioning each other correspond to hip curves and each has wave ruffling; and said wave ruffling is fixed in said tensile layer.

6. A nursing bed, comprising:

a net-shaped fabric with a mesh opening; and a bearing frame;

wherein:

said net-shaped fabric comprises a warp and a weft interwoven in a vertical direction;

an interweaving point of said warp and said weft is fastened by a fixed connection;

the diameter or inscribed circle diameter of said mesh opening is 2-6 times the diameter of said warp and said weft;

the ratio of the area of an opening of said mesh opening to the area of said mesh opening is 35% to 78%;

the diameter or inscribed circle diameter of said mesh opening is less than 1.5 mm:

the diameter of said warp and said weft is less than 0.55 mm;

the thickness of said net-shaped fabric is less than 1.1 mm;

at least two edges of said net-shaped fabric are hung between two opposite edges of said bearing frame whereby forming a mutual positioning structure;

one of two adjacent interweaving points of said warp and said weft is fastened by a fixed connection; and the other one thereof is fastened by an unfixed connection.

7. The nursing bed of claim 6, wherein a tensile layer is disposed at the edge of said net-shaped fabric or along a cutting line thereof.

8. The nursing bed of claim 7, wherein a rigid strip is disposed on said tensile layer;

the width of said rigid strip is less than that of said tensile layer;

said rigid strip and said tensile layer form a fixing edge;

a hanging hole is disposed on said fixing edge;

a hanging column is disposed on said bearing frame;

said hanging hole and said hanging column form a removable positioning structure; and a normal displacement of a fixing edge between adjacent hanging holes due to elastic bending is less than 5 mm.

9. The nursing bed of claim 7, wherein edges of said net-shaped fabric and said bearing frame mutually positioning each other correspond to hip curves and each has wave ruffling; and said wave ruffling is fixed in said tensile layer.

10. The nursing bed of claim 7, wherein said bearing frame is a rectangular frame formed by a pair of long edges and a pair of short edges;

the distance between said long edges and that between said short edges are adjustable;

an adjusting range of said long edges is no greater than 6 cm;

an adjusting range of said short edges is no greater than 9 cm;

said long edges simultaneously move in a reverse direction and said short edges separately move during adjustment; and movement of said long edges and said short edges can be fixed at any position.

* * * * *